US005667026A

United States Patent [19]

Lorenz et al.

[11] Patent Number: 5,667,026

[45] Date of Patent: Sep. 16, 1997

[54] POSITIONING APPARATUS FOR A POWER TONG

[75] Inventors: Jorg Lorenz, Burgwedel; Joerg-Erich Schulze-Beckinghausen, Garbsen, both of Germany

[73] Assignee: Weatherford/Lamb, Inc., Houston, Tex.

[21] Appl. No.: 545,642

[22] PCT Filed: Oct. 7, 1994

[86] PCT No.: PCT/GB94/02192

§ 371 Date: Oct. 30, 1995

§ 102(e) Date: Oct. 30, 1995

[87] PCT Pub. No.: WO95/10686

PCT Pub. Date: Apr. 20, 1995

[30] Foreign Application Priority Data

Oct. 8, 1993 [DE] Germany ..... 43 34 378.3

[51] Int. Cl.[6] ..... E21B 19/14

[52] U.S. Cl. ..... 175/162; 81/57.35

[58] Field of Search ..... 81/57.24, 57.35; 175/162, 172, 85

[56] References Cited

U.S. PATENT DOCUMENTS

| | | | |
|---|---|---|---|
| 2,509,853 | 5/1950 | Wilson | 255/35 |
| 2,550,045 | 12/1951 | DeHetre | 81/57 |
| 3,799,009 | 3/1974 | Guier | 81/57.16 |
| 3,883,009 | 5/1975 | Swoboda, Jr. et al. | 214/1 B |
| 3,885,679 | 5/1975 | Swoboda et al. | 214/1 BD |
| 4,013,178 | 3/1977 | Brown et al. | 214/2.5 |
| 4,077,525 | 3/1978 | Callegari et al. | 214/2.5 |
| 4,117,941 | 10/1978 | McCleskey, Jr. et al. | 214/2.5 |
| 4,274,777 | 6/1981 | Scaggs | 414/22 |
| 4,478,111 | 10/1984 | Wells et al. | 81/57.35 |
| 4,629,014 | 12/1986 | Swisher et al. | 175/220 |
| 4,735,270 | 4/1988 | Fenyresi | 175/113 |
| 4,971,162 | 11/1990 | Back | 175/103 |
| 5,102,375 | 4/1992 | Featherstone | 474/155 |
| 5,368,113 | 11/1994 | Schulze-Beck. | 175/162 |

FOREIGN PATENT DOCUMENTS

| | | |
|---|---|---|
| 0475006A1 | 10/1990 | European Pat. Off. . |
| 0593803A1 | 5/1994 | European Pat. Off. . |
| 1297285 | 5/1961 | France . |
| 2153303 | 9/1972 | France . |
| 2346549 | 3/1977 | France . |
| 2209695 | 3/1972 | Germany . |

OTHER PUBLICATIONS

"Ridig Pushing Chains," Serapid USA, Inc., 1992.

*Primary Examiner*—William P. Neuder
*Attorney, Agent, or Firm*—Guy McClung

[57] ABSTRACT

A positioning apparatus for moving a power tong (110) between an operative and an inoperative position is a drilling tower (105) comprises a first arm (102) and a second arm (103). One end of the first arm (102) is pivotally connected to one end of the second arm (103) at pivot (106) whilst the other end of both the first arm (102) and the second arm (103) are pivotally mounted on a beam (104) attached to the drilling tower (105). Both arms (102, 103) can be extended and retracted in unison to move the power tong (110) towards and away from its operation position circumjacent a pipe string.

14 Claims, 5 Drawing Sheets

POSITIONING APPARATUS FOR A POWER TONG

Figure 1:
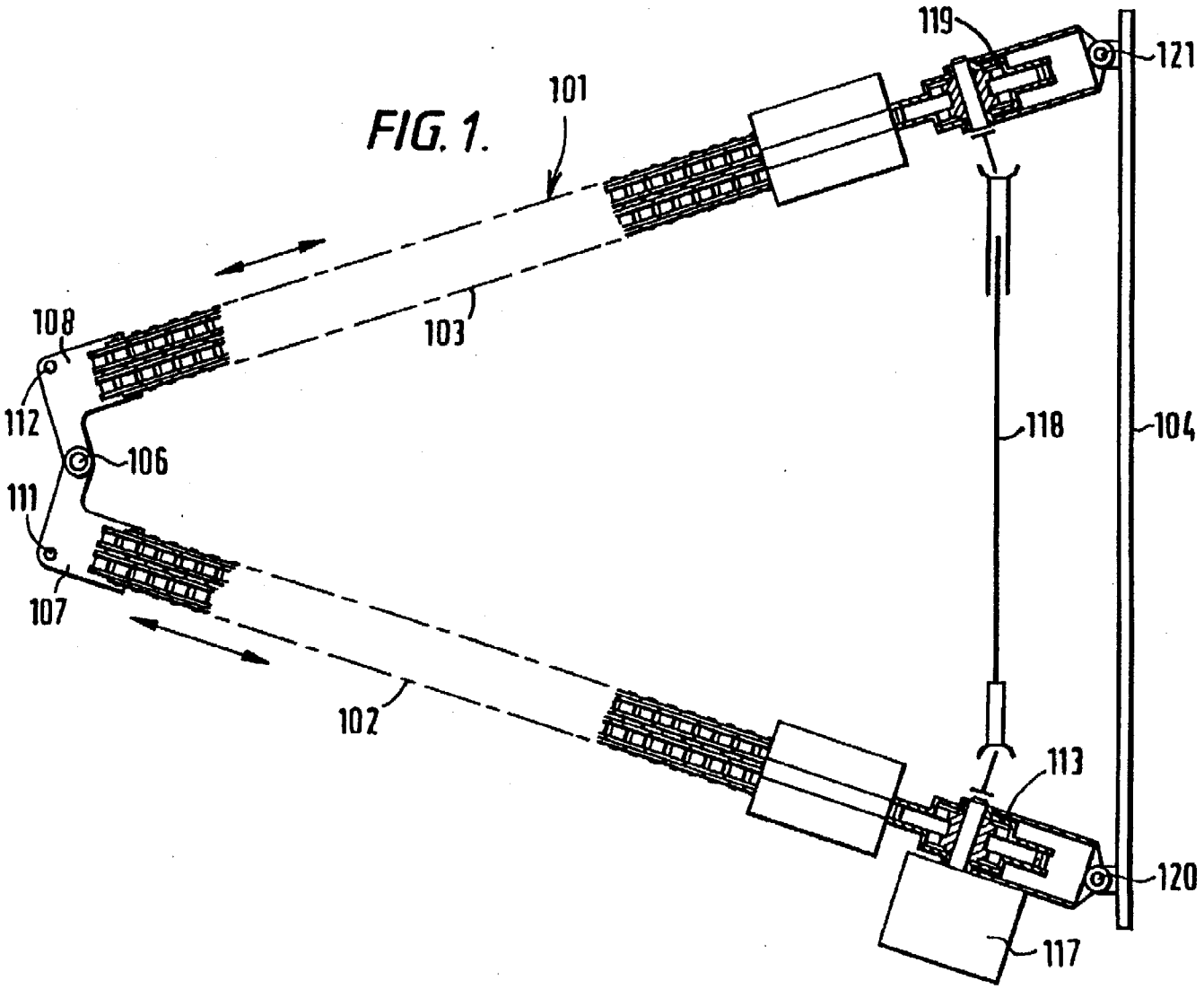

This invention relates to a positioning apparatus for moving a power tong between an operative and an inoperative position in a drilling rig.

Power tongs are used to connect and disconnect threaded tubulars used in the construction of oil and gas wells.

Typically, for example as shown in U.S. Pat. No. 3 799 009, power tongs are suspended by a cable attached to a support member high in the drilling tower. When it is desired to connect or disconnect two threaded tubulars the power tong is manually swung into position and closed circumjacent the tubulars. When the operation is completed the power tong is released and allowed to swing back into an inoperative position.

Manoeuvring the power tong requires considerable strength and is very difficult when the power tong is designed for handling large diameter tubulars and is thus very heavy.

In EP-A-0 593 803 (which was not published until after the priority date of this application) the Applicants describe a positioning apparatus for assisting in the positioning of power tongs. Whilst this positioning apparatus allows a power tong to be easily manipulated it is still desirable to have a rig hand in the immediate vicinity of the tubulars to ensure that the power tong is correctly placed on the tubulars.

The present invention, at least in its preferred embodiments, aims to obviate the need for a rig hand in the immediate vicinity of the power tong.

According to the present invention there is provided a positioning apparatus for moving a power tong between an operative and an inoperative position in a drilling tower, which positioning apparatus comprises a first arm and a second arm, one end of said first arm being pivotally mounted to one end of said second arm and the other end of both said first arm and said second arm being pivotally mountable on said drilling tower with said first arm and said second arm converging towards one another, and means for extending and retracting said first arm and said second arm.

Preferably, the positioning apparatus includes a beam and the other end of both said first arm and said second arm are pivotally mounted on said beam.

Advantageously, the positioning apparatus includes means for extending and retracting said first arm and said second arm in unison.

In one embodiment, at least one of said first and second arms is formed by the interconnection of two chains the links of one of which chains are provided with blocking members which can co-operate with the links of the other chain to form said arm.

In another embodiment at least one of said first and second arms is formed by a piston and cylinder which is preferably double acting.

In a further embodiment, at least one of said first and second arms comprises a rack which can be moved by rotation of a pinion or a worm drive engaged therewith.

Preferably, the positioning apparatus includes a cable for supporting said first arm and said second arm in a generally horizontal plane.

The present invention also provides a drilling tower provided with a positioning apparatus in accordance with the present invention.

Preferably, said first arm and said second arm are supported in a generally horizontal plane.

Advantageously, said one ends of said first arm and said second arm are pivotally mounted together about a generally vertical axis and said other ends of said first arm and said second arm are pivotally mounted about a generally vertical axis.

Preferably, said other ends of said first arm and said second arm are pivotally mounted for movement about a generally horizontal axis.

Advantageously, said drilling tower includes a power tong supported by said positioning apparatus.

Preferably, said power tong is supported via two support members which are attached one to either side of said power tong and are attached to respective ends of said arms to either side of the pivotal connection thereof.

Figure 2:
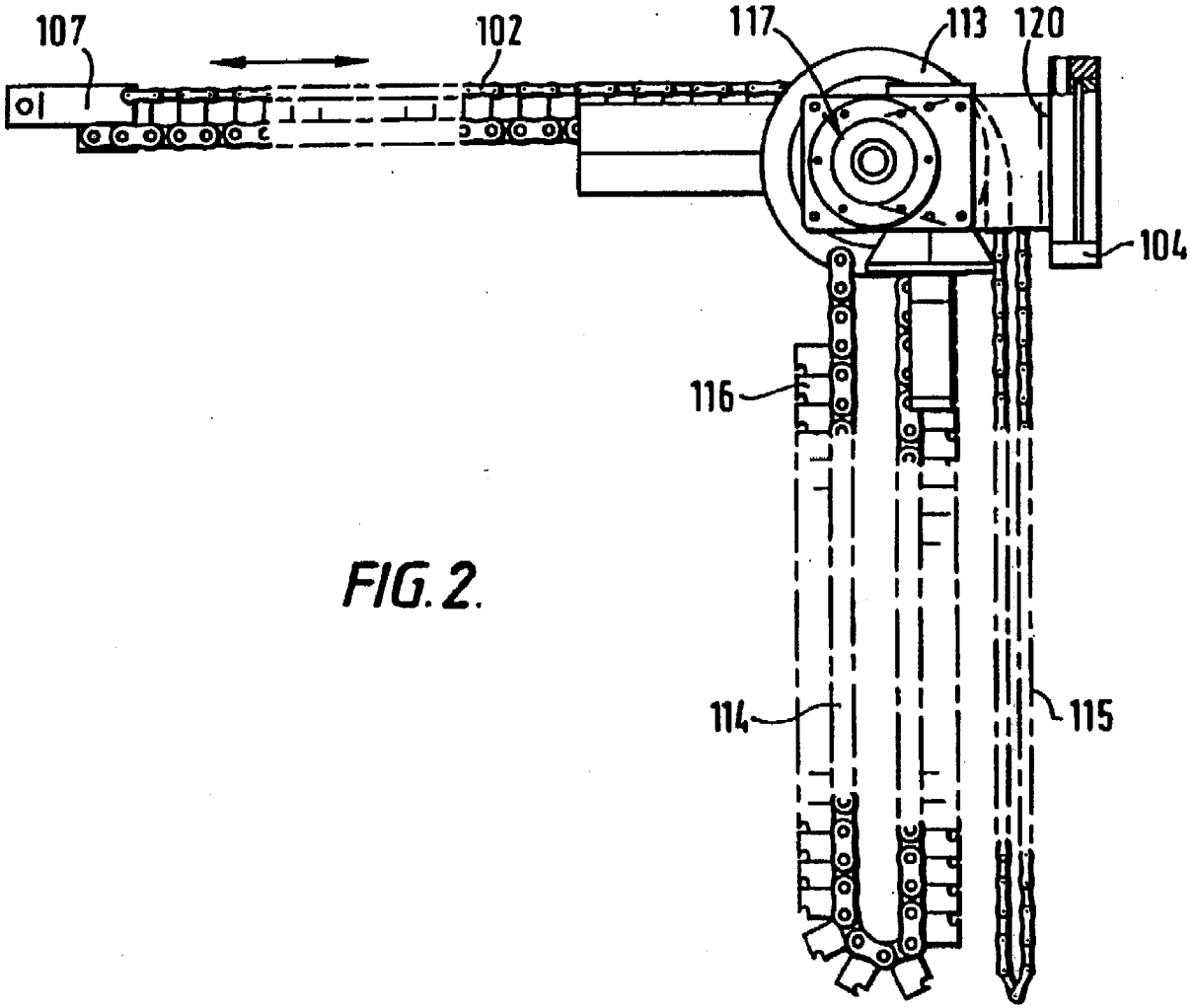
Figure 3:
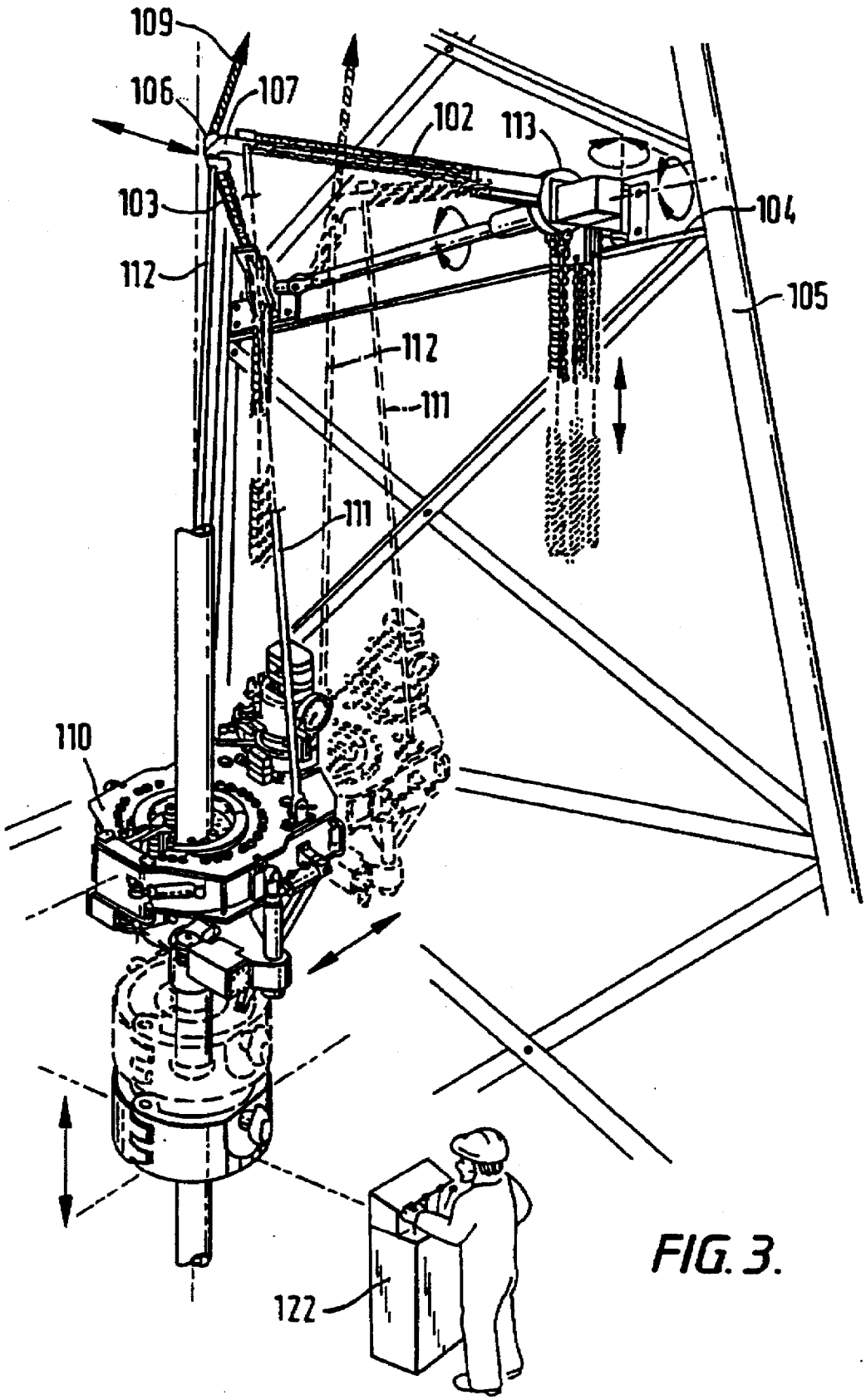
Figure 4:
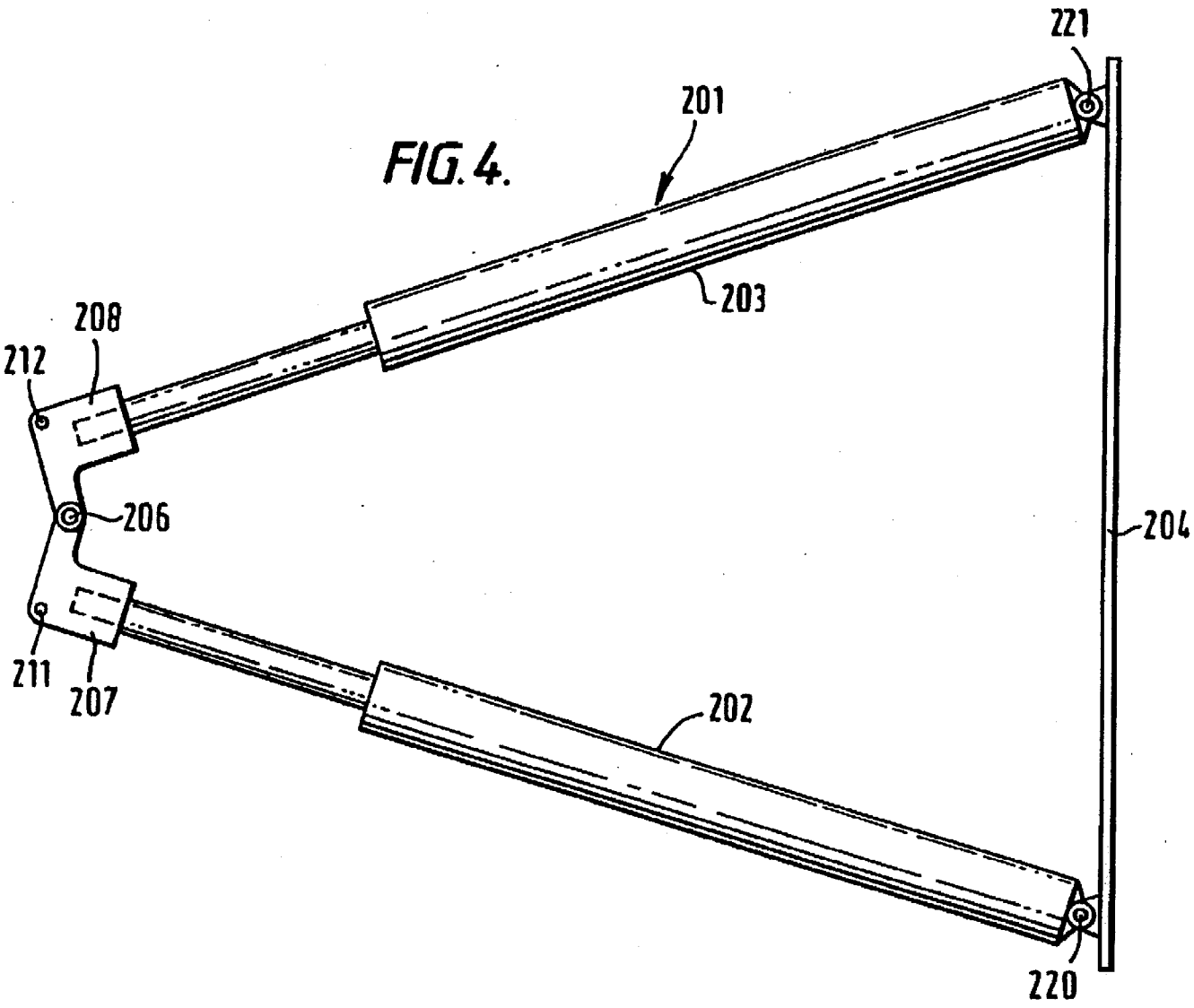
Figure 5:
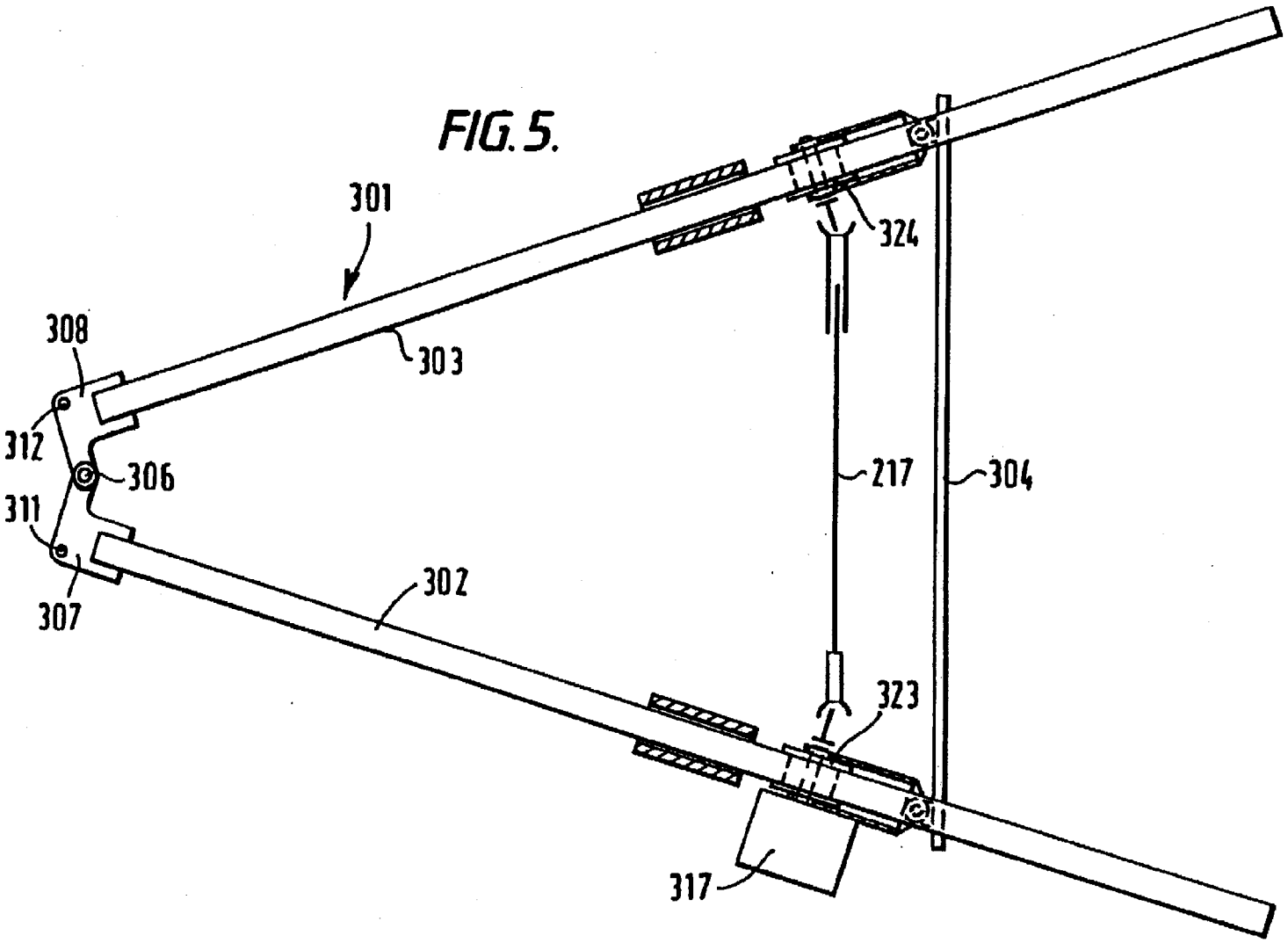

For a better understanding of the present invention reference will now be made, by way of example, to the accompanying drawings, in which:

FIG. 1 is a plan view of one embodiment of a positioning apparatus in accordance with the present invention;

FIG. 2 a side elevation of the positioning apparatus shown in FIG. 1;

FIG. 3 a perspective view of the positioning apparatus shown in FIGS. 1 and 2 in use in a drilling tower;

FIG. 4 is a plan view of a second embodiment of a positioning apparatus in accordance with the present invention; and FIG. 5 is a plan view of a third embodiment of a positioning apparatus in accordance with the present invention.

Referring to FIGS. 1 to 3 of the drawings there is shown a positioning apparatus which is generally identified by reference numeral 101.

The positioning apparatus 101 comprises two arms 102, 103 of variable length which are pivotally mounted on a beam 104 attached to a drilling tower 105.

The arms 102, 103 and the beam 104 together form a support triangle lying in a substantially horizontal plane.

The arms 102, 103 are pivotally interconnected at hinge 106 by means of end plates 107 and 108.

A cable 109 (FIG. 3) is secured between a support member high in the drilling tower 105 and the hinge 106.

A power tong 110 driven by a motor 130 is suspended from the support triangle by two rods 111, 112 which extend from opposite sides of the power tong 110 to the end plates 111 and 112.

Each of the arms 102 and 103 forms part of a mechanism 113 which is described in detail in EP-A-0 593 803 which is fully incorporated herein for all purposes. In particular the mechanism 113 comprises two chains 114 and 115. Each link of chain 114 is provided with a blocking member 116.

When a hydraulic motor 117 is rotated anti-clockwise as viewed in FIG. 2 the links of the chain cooperate with the blocking members 116 to form arm 102 which is relatively rigid.

A connecting rod 118 connects the mechanism 113 to a similar mechanism 119 so that when the hydraulic motor 117 is rotated both arms 102 and 103 extend and retract in unison.

When it is desired to make-up or break-out a joint hydraulic motor 117 is actuated so that the arms 102 and 103 extend and the power tong 110 is moved to an operative position as shown in full lines in FIG. 3. When the operation is complete the hydraulic motor 117 is reversed and the arms 102 and 103 contract to move the power tong 110 to an inoperative position shown in chain lines in FIG. 3.

Each arm 102, 103 is pivotally mounted on the beam 104 by hinges 120, 121 respectively which pivot inwardly and outwardly as the arms 102, 103 are retracted and extended respectively.

The positioning apparatus 101 is operated from a remote control panel 122.

The positioning apparatus 101 shown in FIG. 4 is generally similar to that shown in FIG. 1 except that the arms 202 and 203 comprise double acting piston and cylinder assemblies which may be hydraulically or pneumatically operable, the former being recommended for precise control as hydraulic fluid is substantially incompressible. If desired, the arms 202, 203 could comprise single acting piston and cylinder assemblies acting against a return spring.

In the positioning apparatus 301 shown in FIG. 5 the arms 302, 303 comprise racks which can he extended and retracted by rotation of pinions 323 and 324 by hydraulic motor 317.

It will be noted that in all the embodiments described the hinges 106, 206, 306, 120, 220, 320, 121, 221 and 321 all pivot about a generally vertical axis. In addition, it may he desirable to mount the ends of the arms remote from the hinges 106, 206, 306 for pivotal movement about a generally horizontal axis to accommodate the small vertical movement of hinges 106, 206, 306 as the arms are extended and retracted caused by the fixed length of the cable 109. This could conceivably be achieved by modifying the hinges or, alternatively, mounting the beam 104 for pivotal movement about a generally horizontal axis on the drilling tower 105.

What is claimed is:

1. A positioning apparatus for moving a power tong between an operative and an inoperative position in a drilling tower, said power tong driven by a motor, which positioning apparatus comprises a first arm and a second arm one end of said first arm being pivotally mounted to one end of said second arm and the other end of both said first arm and said second arm being pivotally mountable on said drilling tower with said first arm and said second arm converging towards one another, means for extending and retracting said first arm and said second arm.

2. A positioning apparatus as claimed in claim 1, including a beam, wherein said other end of both said first arm and said second arm are pivotally mounted on said beam.

3. A positioning apparatus as claimed in claim 1, including means for extending and retracting said first arm and said second arm in unison.

4. A positioning apparatus as claimed in claim 1, wherein at least one of said first and second arms is formed by the interconnection of two chains the links of one of which chains are provided with blocking members which can co-operate with the links of the other chain to form said arm.

5. A positioning apparatus as claimed in claim 1, wherein at least one of said first and second arms is formed by a piston and cylinder.

6. A positioning apparatus as claimed in claim 5, wherein said piston and cylinder is double acting.

7. A positioning apparatus as claimed in claim 1, wherein at least one of said first and second arms comprises a rack which can be moved by rotation of a pinion or a worm drive engaged therewith.

8. A positioning apparatus as claimed in claim 1, including a cable for supporting said first arm and said second arm in a generally horizontal plane.

9. A positioning apparatus for moving a power tong between an operative and an inoperative position in a drilling tower, said power tong driven by a motor, which positioning apparatus comprises a first arm end a second arm one end of said first arm being pivotally mounted to one end of said second arm and the other end of both said first arm and said second arm being pivotally mountable on said ddrilling tower with said first arm and said second arm converging towards one another, and means for extending and retracting said first arm and said second arm, and means for extending and retracting said first arm and said second arm in unison.

10. A positioning apparatus as claimed in claim 9, including a beam, wherein said other end of both said first arm and said second arm are pivotally mounted on said beam.

11. A positioning apparatus as claimed in claim 9, wherein at least one of said first and second arms is formed by the interconnection of two chains the links of one of which chains are provided with blocking members which can co-operate with the links of the other chain to form said arm.

12. A positioning apparatus as claimed in claim 9, wherein at least one of said first and second arms is formed by a piston and cylinder.

13. A positioning apparatus as claimed in claim 12, wherein said piston and cylinder is double acting.

14. A positioning apparatus as claimed in claim 9, wherein at least one of said first and second arms comprises a rack which can be moved by rotation of a pinion or a worm drive engaged therewith.

* * * * *